US005175949A

United States Patent [19]

Seidel

[11] Patent Number: 5,175,949

[45] Date of Patent: Jan. 5, 1993

[54] SKI BOOT WITH SELECTIVE TENSIONING DEVICE

[75] Inventor: Sigurd Seidel, Graz, Austria

[73] Assignee: Raichle Sportschuh AG, Kreuzlingen, Switzerland

[21] Appl. No.: 599,484

[22] Filed: Oct. 18, 1990

[30] Foreign Application Priority Data

Oct. 20, 1989 [CH] Switzerland ..... 03814/89

[51] Int. Cl.[5] ..... A43B 5/04

[52] U.S. Cl. ..... 36/119; 36/120

[58] Field of Search ..... 36/117, 118, 119, 120, 36/121

[56] References Cited

U.S. PATENT DOCUMENTS

| | | | |
|---|---|---|---|
| 4,160,332 | 7/1979 | Salomon | 36/119 |
| 4,186,501 | 5/1980 | Salomon | 36/121 |
| 4,382,342 | 5/1983 | Spademan | 36/119 |
| 4,499,676 | 2/1985 | Chalmers, II | 36/120 |
| 4,551,933 | 11/1985 | Morell et al. | 36/120 |
| 4,570,364 | 2/1986 | Walkhoff | 36/121 |
| 4,581,831 | 4/1986 | Kirsch | 36/119 |
| 4,593,483 | 6/1986 | Paris | 36/119 |
| 4,670,999 | 6/1987 | Olivieri | 36/119 |
| 4,724,626 | 2/1988 | Baggio | 36/119 X |
| 4,735,004 | 4/1988 | Dodge | 36/117 |
| 4,748,751 | 6/1988 | Sartor | 36/119 |
| 4,884,349 | 12/1989 | Bataille | 36/119 |
| 4,888,889 | 12/1989 | Sartor | 36/117 |
| 4,922,634 | 5/1990 | Seidel | 36/119 |
| 5,060,403 | 10/1991 | Battistella et al. | 36/117 |

FOREIGN PATENT DOCUMENTS

| | | | |
|---|---|---|---|
| 0111822 | 6/1984 | European Pat. Off. . | |
| 0157118 | 10/1985 | European Pat. Off. | 36/119 |
| 0229638 | 7/1987 | European Pat. Off. . | |
| 0321714 | 6/1989 | European Pat. Off. . | |
| 0335047 | 10/1989 | European Pat. Off. . | |
| 2738523 | 4/1981 | Fed. Rep. of Germany . | |
| 2399811 | 4/1979 | France | 36/119 |
| 2425207 | 1/1980 | France | 36/120 |
| 2564711 | 11/1985 | France . | |
| 8002789 | 12/1980 | World Int. Prop. O. | 36/119 |

*Primary Examiner*—Paul T. Sewell
*Assistant Examiner*—Beth Anne Cicconi
*Attorney, Agent, or Firm*—Oliff & Berridge

[57] ABSTRACT

An upper shaft part of the ski boot is pivotable on a lower shaft part about an axis (20) from a standing position, which runs approximately at right angles to the sole (14), into a forwardly inclined rest position which corresponds to the skiing position. This pivoting movement of the upper shaft part (16) when the ski boot is closed is transmitted to transmission members (86), which are displaceable in the longitudinal direction of the boot, by means of actuating levers (82). The movement of the transmission members (86) toward a heel element (98) is converted into a pushing forward of a tensioning member (90) by means of toothed wheels (94). Thereupon, the effective part loops (106,108) of the tensioning element (102), which are guided around the tensioning member (90), are shortened. When the upper shaft part (16) is in the rest position, the foot is consequently retained by the retaining element (96) and the heel cap (100). When the upper shaft part (16) is pivoted back into the standing position, the foot is free inside the ski boot.

18 Claims, 7 Drawing Sheets

Fig. 6
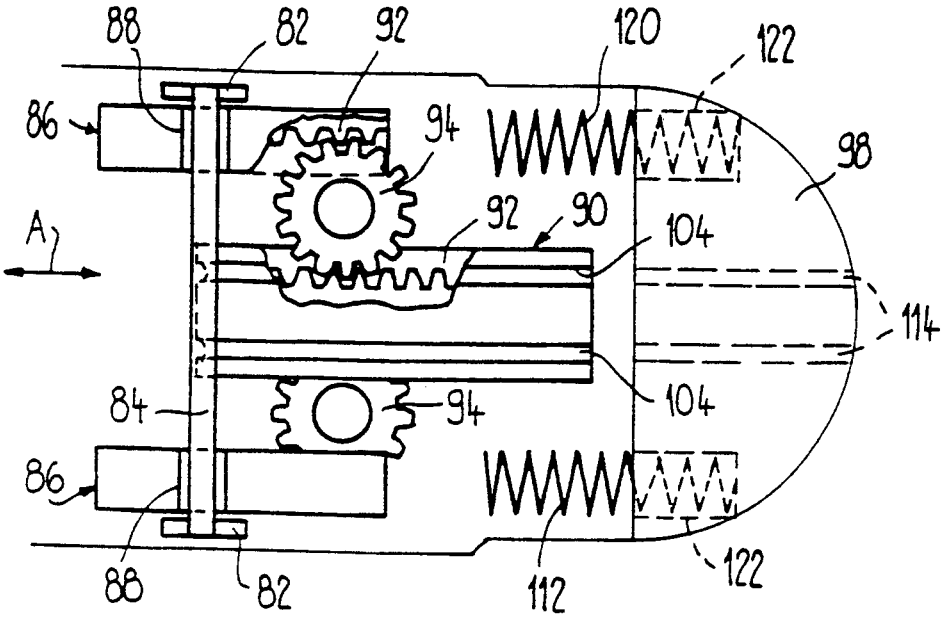
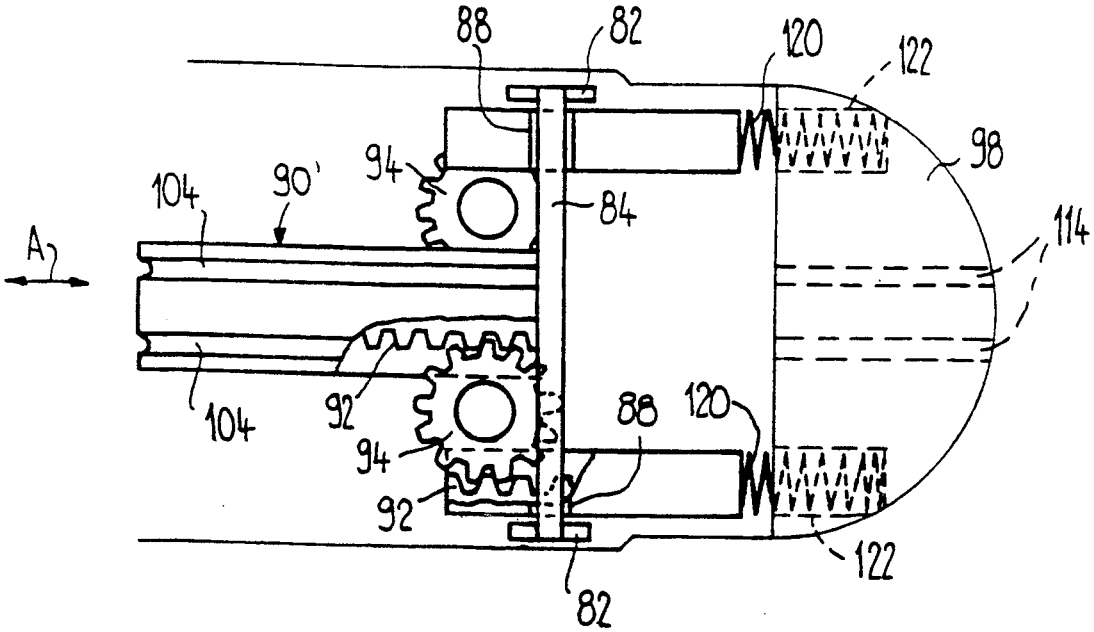
Fig. 7

SKI BOOT WITH SELECTIVE TENSIONING DEVICE

BACKGROUND OF THE INVENTION

1. Field of the Invention

The present invention relates to a ski boot provided with a sole and a shaft, a lower shaft part enclosing the foot, a front shaft part surrounding the lower tibia area, and a rear shaft part provided in the area of the heel and the lower fibula pivotable about an axis which runs approximately parallel to the sole and transversely to a longitudinal direction of the boot.

2. Description of the Related Art

A ski boot of this type is known, for example, from U.S. Pat. No. 4,160,332. This boot has a lower shaft part which surrounds the foot and on which a front shaft part, which surrounds the lower tibia area, is formed in one piece. A rear shaft part, which is provided in the heel and lower fibula area, is pivotably articulated on the lower shaft part in the area of the ankle about an axis which runs parallel to the sole and at right angles to the longitudinal direction of the boot. Inside the ski boot, a foot retaining element is provided with a band-shaped tensioning element which runs over the instep. The latter element is connected to a tensioning cable which is guided through under the articulation of the rear shaft part on the lower shaft part and which is suspended alternatively on one of a number of teeth on the rear shaft part which are arranged above one another. To open the ski boot, the rear shaft part is pivoted backwards, as a result of which the tensioning cable, and consequently the foot retaining element, is released. Upon closing the ski boot, the rear shaft part is pivoted in a forward direction, the tensioning cable being tensioned and the foot retaining element consequently being pulled in a direction towards the heel as a result of this pivoting movement. With the ski boot closed, the foot retaining element is consequently always tensioned and a release of the foot retaining element is only possible by means of opening the ski boot. An open ski boot, however, is extremely undesirable for traveling by means of a lift or when walking. In order to make possible a relaxation of the foot with the ski boot closed, the ski boot must be opened and the tensioning cable released from the relevant tooth and suspended on a tooth arranged lower down. Subsequently, the ski boot is to be closed again by means of forward pivoting of the rear shaft part, as a result of which the foot retaining element is then less tensioned. In a similar manner, for the next descent, the foot retaining element is then to be tensioned more strongly again by means of renewed suspension of the tensioning cable on a tooth arranged higher up. This procedure is extremely elaborate and complicated.

SUMMARY OF THE INVENTION

It is therefore an aim of the present invention to provide a ski boot of the generic type, which, with the ski boot closed, permits the foot retaining element to be tensioned and released.

This aim is achieved by means of a foot retaining device arranged inside the ski boot and being connected to a tensioning device which can be activated by means of pivoting of the rear shaft part.

According to the invention, with the ski boot closed, the front and rear shaft part can be pivoted jointly from a standing position, which runs approximately perpendicularly to the sole, into a rest position which is inclined forwards. Upon the joint pivoting movement of the front and rear shaft part into the rest position, the foot retaining element is tensioned. The rest position corresponds in this connection to the usual position of the front and rear shaft part upon descent. To open the ski boot, the front and rear shaft parts are consequently pivoted back into the standing position and, after the ski boot has been put on and closed, these two shaft parts are pivoted jointly forward into the rest position for the descent, which at the same time leads to a tensioning of the foot retaining element. The present invention consequently allows standing upright without the lower leg being held in a position which is inclined forward. At the same time, the foot retaining element is also released, which makes possible a relaxation of the foot with the ski boot closed. As the front and rear shaft part can be pivoted backwards and forwards between the standing position and the rest position with the boot closed, problem-free walking is moreover possible with the ski boot according to the invention.

BRIEF DESCRIPTION OF THE DRAWINGS

A more complete understanding of the invention can be made by reference to the accompanying drawings, wherein:

FIGS. 6 to 9 show in a top view and elevation view respectively the tensioning device in two different positions.

DETAILED DESCRIPTION OF PREFERRED EMBODIMENTS

Figure 1:
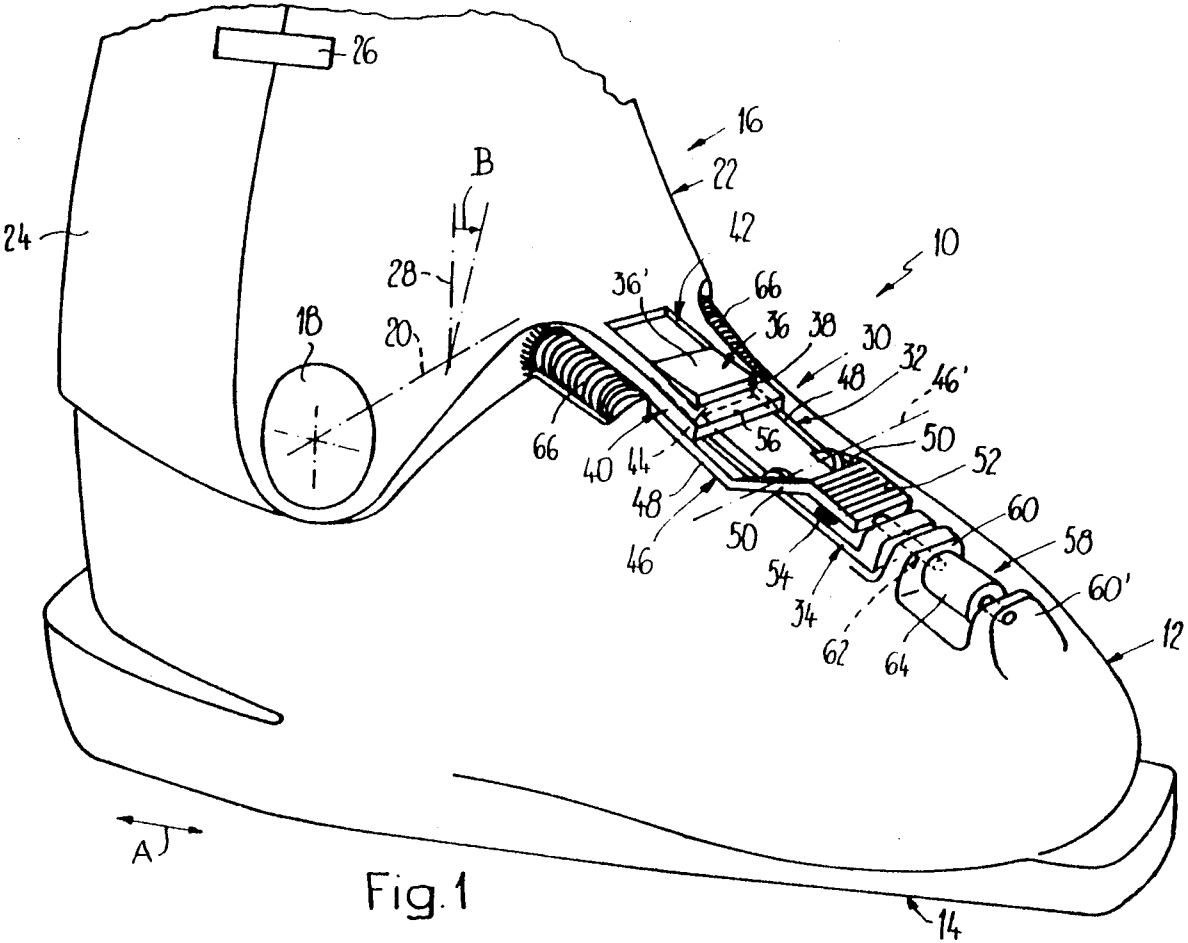
FIGS. 1 to 3 show in a perspective representation a ski boot with a catch device for the releasable holding of the upper shaft part in a rest position which is inclined forward.
Figure 2:
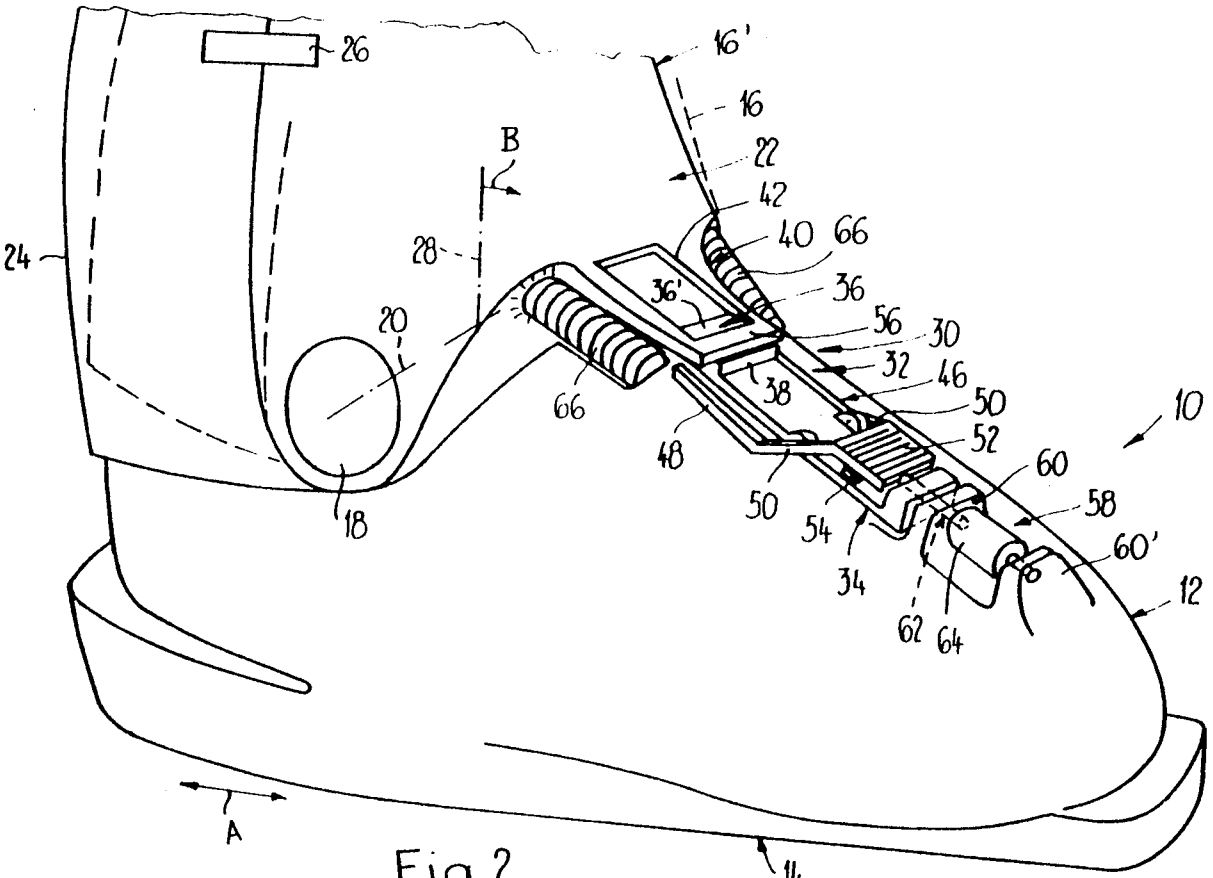
Figure 3:
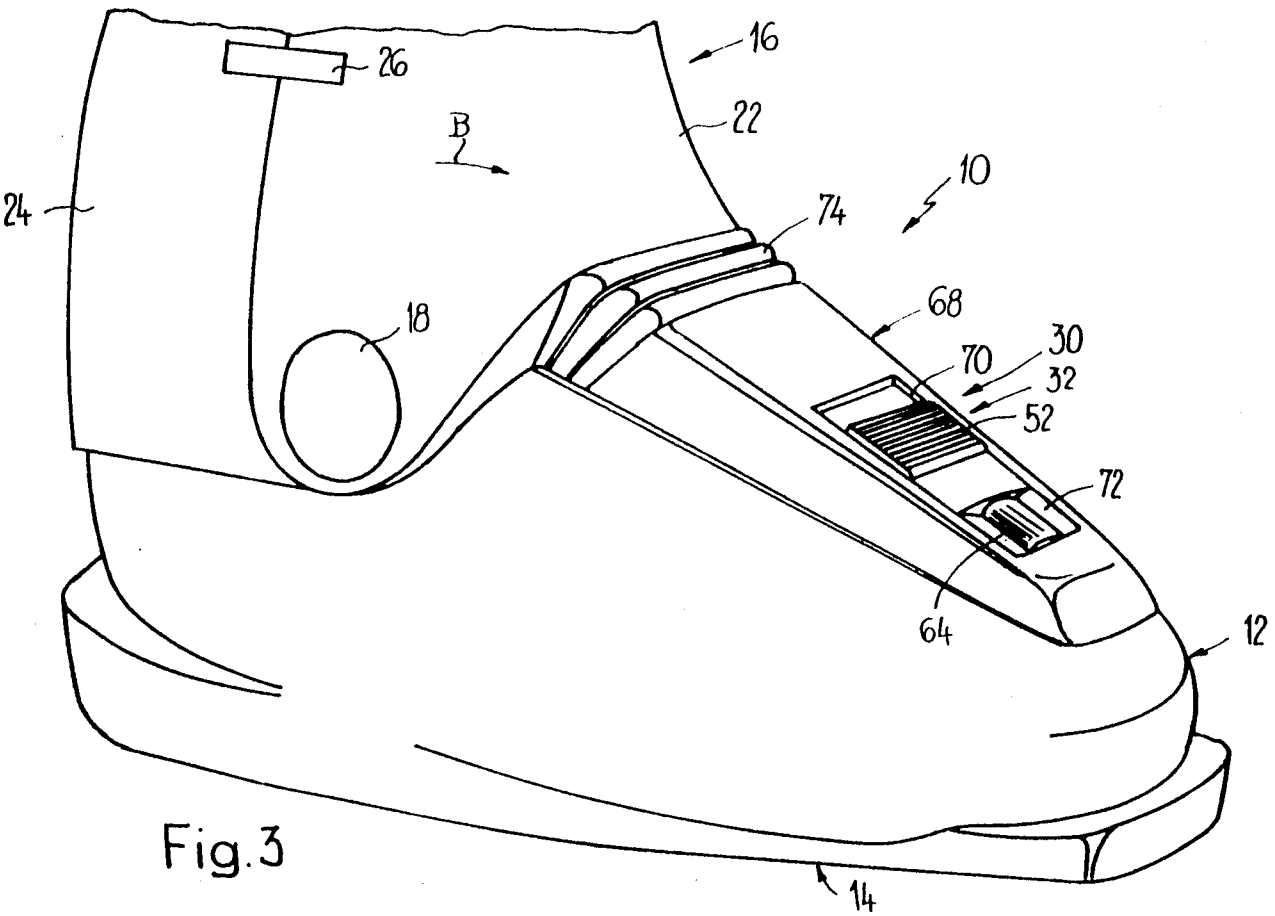

The shaft 10, which is made of, for example, synthetic material, of the ski boot represented in FIGS. 1 to 3, has a lower shaft part 12, with a sole 14 formed thereon, which surrounds the foot. On the lower shaft part 12, in the area of the ankle, an upper shaft part 16 is pivotably articulated about an axis 20, which runs essentially parallel to the sole 14 and at right angles to the longitudinal direction A of the boot, by means of schematically indicated joints 18, of which only one is visible in the figures. The upper shaft part 16 has a front shaft part 22, which encloses the lower tibia area, and a rear shaft part 24 which encloses the heel and lower fibula area. These two shaft parts 22 and 24 are mounted on the joints 18 and, by means of a known, schematically indicated closure 26, can be tensioned against one another in order to surround the lower leg area of the skier. To open the ski boot, the closure 26 is opened and the rear shaft part 24 is pivoted backwards about the axis 20.

In FIGS. 1 and 3, the upper shaft part 16 is presented pivoted into a rest position which, in relation to a perpendicular 28 to the sole 14, is inclined in a forward direction about the axis 20 in arrow direction B. The rest position corresponds to the usual position when skiing. In FIG. 2, this rest position is indicated in broken lines and designated as 16. In solid lines, the upper shaft part is represented in its standing position which is indicated by 16, and in which it is pivoted out of the rest position 16 in a direction towards the perpendicular 28 counter to arrow direction B.

In the instep area, a retaining device 30 with a catch device 23 is provided for the releasable retention of the upper shaft part 16 in its forwardly inclined rest position. The catch device 32 has a slide 34 which is displaceably mounted on the lower shaft part 12 approximately in the longitudinal direction A of the boot. The slide 34 is displaceably mounted in the lower shaft part 12, by means of a dovetail or keyway guide, for example. In the rear end area, seen in the longitudinal direction A of the boot, the slide 34 has an upwardly projecting nose 36 with a stop surface 38. A catch tongue 40, which projects into the area of the slide 34, is formed on the front shaft part 22. This tongue has a passage 42 which is rectangular in cross-section and the front limit of which, seen in the longitudinal direction A of the boot, forms a counterstop surface 44. In the central area of the slide 34, a fork-shaped double-armed lever 46 is pivotably mounted thereon about an axis 46' which runs parallel to the sole 14 and at right angles to the longitudinal direction A of the boot. The lever arms 48, which run alongside the slide 34 and are directed backwards from the axis 46', engage with their free end areas under the catch tongue 40. The lever arms 50, which in relation to the axis 46' project forward in the longitudinal direction A of the boot, are connected to one another by means of a plate-shaped connecting part 52 which is arranged above and approximately parallel to the slide 34. Between the connecting part 52 and the slide 34, a pressure spring 54 is provided, which holds the double-armed lever 46 in a counter-clockwise direction in the position shown in FIGS. 1 and 2. In FIG. 1, the counterstop surface 44 of the catch tongue 40 bears against the stop surface 38 of the nose 36, as a result of which the upper shaft part 16 is held in its rest position which is inclined in a forward direction. In FIG. 2, the stop and counterstop surfaces 38, 44 have been brought out of overlap and the catch tongue 40 lies with its connecting web 56, which is provided on the front end area and limits the passage 42 towards the front, on a sliding surface 36' of the nose 36.

The slide 34 is adjustably retained in its position in relation to the longitudinal direction A of the boot by means of a spindle drive 58. In the toe area, the lower shaft part 12 has two upwardly projecting bearing bosses 60, 60', on which a spindle 62 of the spindle drive 58 is mounted in a freely rotatable but, seen in the longitudinal direction A of the boot, stationary manner. The axis of rotation of the spindle 62 runs in the central longitudinal plane of the boot and essentially parallel to the surface of the lower shaft part 12. In the area which projects in a backward direction from the rear bearing boss 60, the spindle 62 has a thread (not shown in the Figures), in which the slide 34 runs as a running nut. In the area between the two bearing bosses 60, 60', the spindle 62 is designed as a thickened operating roller 64.

Laterally below the catch tongue 40, two pressure spring elements 66 are provided, which rest at one end on the lower and at the other end on the front shaft part 12, 22 (FIGS. 1 and 2). As shown in FIG. 3, the retaining device 30 with the catch device 32 according to FIGS. 1 and 2 is covered by a shell-shaped cover element 68 in order to prevent the penetration of snow and ice. The cover element 68 has recesses on its upper side for the connecting part 52 and the operating roller 64. The cover element 68 extends from the toe area as far as the area of the nose 36 and catch tongue 40. Between the cover element 68 and the front shaft part 22, an elastic bellows 74 is provided, which covers the pressure spring elements 66 and the catch tongue 40 and permits a relative displacement between the cover element 68 and the front shaft part 22.

For skiing, the upper shaft part 16 is pivoted forward in arrow direction B into the rest position shown in FIGS. 1 and 3, in which the counterstop surface 44 bears against the stop surface 38. The rest position 16 consequently corresponds to the usual skiing position. A further forward pivoting, in arrow direction B in relation to the rest position 16, of the upper shaft part 16 by means of forward bending of the lower leg against the force of the pressure spring elements 66, is made possible by the catch device 32. In this connection, the stop and counterstop surfaces 38, 44 lift off from one another and the connecting web 56, as a result of the pretension of the catch tongue 40, slides on the slide 34 in a direction towards the sole 14, in the area between the nose 36 and the axis 46'. A return pivoting counter to arrow direction B beyond the rest position 16 is prevented, however, by the nose 36 and the connecting web 56.

In order to remove the ski boot, for standing upright, traveling by means of the lift or walking, pressure is then applied to the connecting part 52 by means of the ski pole. Thereupon, the double-armed lever 46 pivots in a clockwise direction against the force of the pressure springs 54 and the lever arms 48 raise the front area of the catch tongue 40, against its pretension in the engagement direction, over the nose 36. In this connection, the stop and counterstop surfaces 38, 44 come out of engagement and the upper shaft part 16 can then be pivoted counter to arrow direction B out of the rest position. Upon the lifting off of the ski pole from the connecting part 52, the double-armed lever 46 pivots in an anti-clockwise direction back into the position shown in the figures, as a result of which the connecting web 56 then comes to lie on the nose 36 (cf. FIG. 2). With the catch device 32 released, standing upright and comfortable putting on and removing of the ski boot is consequently possible. Furthermore, when walking, pivoting of the upper shaft part 16 in and counter to arrow direction B between the standing position 16' and the rest position 16 is possible, the connecting web 56 sliding on the sliding surface 36'. Comfortable walking is consequently possible with the ski boot closed. For skiing, the upper shaft part 16 is pivoted into the rest position 16 by means of forward bending of the lower leg in arrow direction B. Thereupon, the connecting web 56 runs off of the catch nose 36, as a result of which, because of the pretension of the catch tongue 40 in the engagement direction, the counterstop surface 44 comes into engagement with the stop surface 38 (FIG. 1). The upper shaft part 16 is then held in the rest position for skiing.

By means of rotating the spindle 62, the position of the slide 34 can be modified approximately in the longitudinal direction (A) of the boot, that is to say in the direction of the relative movement between the catch tongue 40 and the slide 34 upon pivoting of the upper shaft part 16. As a result of this, the desired rest position for the descent can be adjusted.

Figure 4:
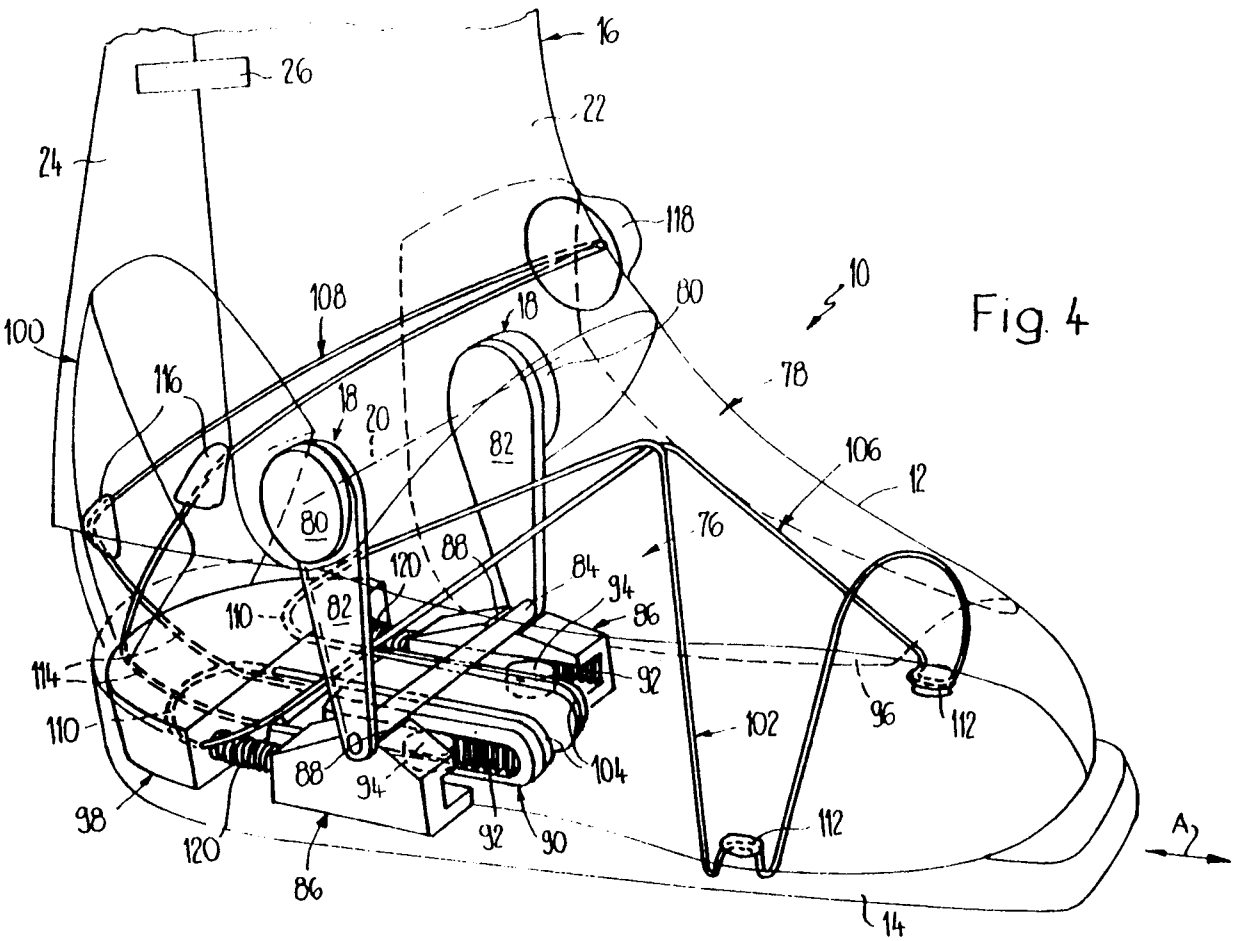
FIG. 4 shows, likewise in a perspective representation, a tensioning device for tensioning a foot retaining element which is arranged inside the ski boot which is represented in a transparent manner.

In FIG. 4, the ski boot shown in FIGS. 1 to 3 is simplified and represented as if assumed to be transparent. For the sake of greater clarity, the retaining device 30 with the catch device 32 is not shown in this FIG. 4. On the lower shaft part 12 with the sole 14, in the area of the ankle, the upper shaft part 16 is pivotably articulated with the front shaft part 22 and the rear shaft part 24 about the axis 20. Inside the ski boot, a tensioning device 76 for a foot retaining device 78 is provided.

The joints 18 each have a pivot pin 80 which is mounted freely rotatably in the lower shaft part 12 and which is connected in a rotationally fixed manner on the one hand to the front shaft part 22 and on the other to a one-armed actuating lever 82 which is provided inside the ski boot and projects in a direction towards the sole 14 from the pivot pin 80. On the two pivot pins 80, the rear shaft part 24 is also pivotably mounted. The two actuating levers 82 are connected to one another at their free ends by means of a cylindrical shaft 84, the longitudinal axis of which runs parallel to the axis 20.

In the area of the sole 14, two profiled transmission members 86, which are at a distance from one another in the direction of the shaft 84, are mounted displaceably in the longitudinal direction A of the boot. Seen in the longitudinal direction A of the boot, the two transmission members 86 each have in their central area a groove 88 which is upwardly open and runs at right angles to the longitudinal direction A of the boot. The shaft 84 runs through the groove 88, the width of the groove 88 only slightly exceeding the diameter of the shaft 84.

Figure 5:
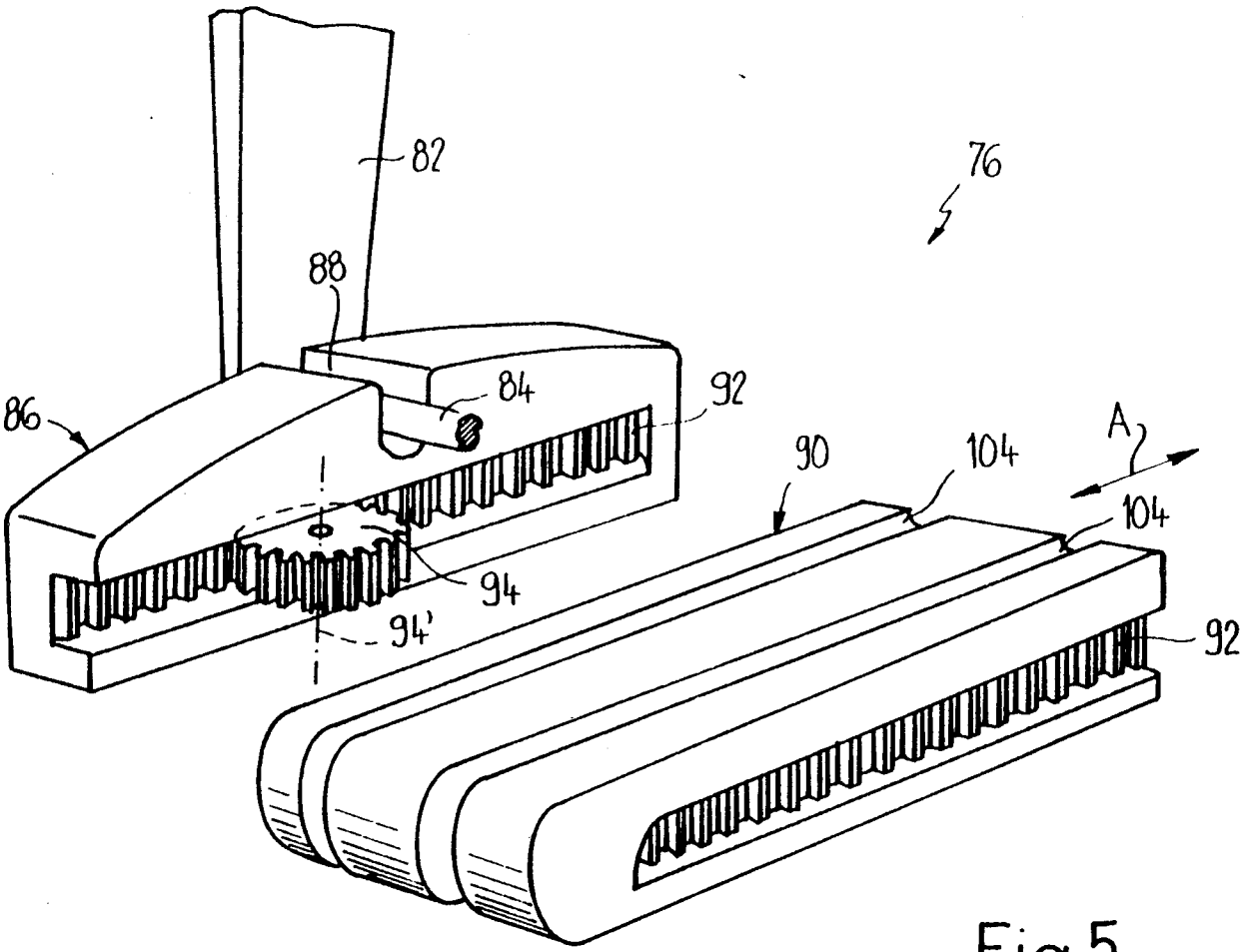
FIG. 5 shows a part of the tensioning device in an exploded representation.

Between the two transmission members 86, a slide-shaped tensioning member 90 is arranged, which is slidingly guided in the longitudinal direction A of the boot likewise. On the sides which face one another, the two transmission members 86 and the tensioning member 90 have rack-shaped toothings 92 which run in the longitudinal direction A of the boot and which engage with two toothed wheels 94 which are provided between the tensioning member 90 and the transmission members 86. The toothed wheels 94 are mounted rotatably (cf. FIG. 5) about axes of rotation 94', which run at right angles to the sole 14, on pins which are not shown. The pins can be arranged on the sole 14, on an inner sole, which is not shown but generally known, or on a bearing part for the tensioning device 76. The toothings 92 and toothed wheels 94 bring about a reversal of the direction of movement of the tensioning member 90 in relation to the transmission members 86. When the transmission members 86 are displaced backwards in the longitudinal direction A of the boot, the tensioning member 90 is moved forward in the longitudinal direction A of the boot and vice-versa.

The foot retaining device 78 is designed in the same manner as is described in full in EP-A 0 321 714 and in the corresponding U.S. Pat. No. 4,922,634. This foot retaining device 78 has a retaining element 96, arranged between the shaft 10 and a generally known padded inner boot (not shown in the Figures), is indicated in broken lines and covers the foot in the instep and tibia area in the form of a saddle, and a heel cap 100 which is pivotably articulated in the heel area on a heel element 98. A cable-shaped tensioning element 102 connects the retaining element 96 and the heel cap 100 to the tensioning device 76. The tensioning member 90 has two guide grooves 104 for the tensioning element 102 (cf. FIG. 5 also). The two guide grooves 104 run parallel to one another and, seen in a direction parallel to the sole 14 and at right angles to the longitudinal direction A of the boot, next to one another forward in the longitudinal direction A of the boot from the upper rear end of the tensioning member 90, around the rounded front end of the tensioning member 90 to the underside which faces the sole 14 and, on this side, back to the rear end of the tensioning member 90, around the rounded front end of the tensioning member 90 to the underside which faces the sole 14 and, on this side, back to the rear end of the tensioning member 90. The cable-shaped tensioning element 102, which forms an endless loop, is guided around the tensioning member 90 once, coming from the heel element 98, in each guide groove 104 and is divided into two part loops 106 and 108 by this member.

In the front part loop 106, the tensioning element 102, starting from one guide groove 104 on the upper side of the tensioning member 90, runs from the latter to the heel element 98 and in this, in a guide channel 110 or around a corresponding deflection roller, is deflected in an outward direction by approximately 180°. Subsequently, the tensioning element 102 crosses the retaining element 96 in the instep area and is guided from there to a deflection eye 112 which is provided on the sole 14. Coming from the deflection eye 112, the tensioning element 102 crosses the retaining element 96 in the front end area and is guided to a further deflection eye 112 which, in relation to the central longitudinal plane of the boot, is symmetrical to the deflection eye 112, and from which further deflection eye 112 of the tensioning element 102 again runs over the retaining element 96 in the instep area to the other side of the ski boot and backwards to the heel element 98, where it is again deflected by approximately 180° in a guide channel 110 and is conducted to the other guide groove 104 in the tensioning member 90.

In the rear part loop 108, the cable-shaped tensioning element 102, starting from a guide groove 104 on the underside of the tensioning member 90, runs backward to the heel element 98, where it is guided in a further guide channel 114 to its rear end. From there, the tensioning element 102 runs around the heel cap 100 to the other side of the ski boot, where it is guided by means of a guide projection 116 which is formed on the heel cap 100. Coming from there, the tensioning element 102 crosses the retaining element 96 in its upper end area and runs to a corresponding guide projection 116 on the heel cap 100 on the other side of the ski boot. From there, the tensioning element 102 is guided around the heel cap 100 to the other side of the ski boot, from where it is guided, in a further guide channel 114, to the other guide groove 104. 118 indicates an adjustment element which is arranged on one side of the ski boot above the corresponding joint 18 and by means of which the length of the endless loop of the tensioning element 102 can be adjusted. On the heel element 98, two damping springs 120 are arranged, against which the transmission members 86 run up upon moving in a direction toward the heel element 98.

Figure 8:
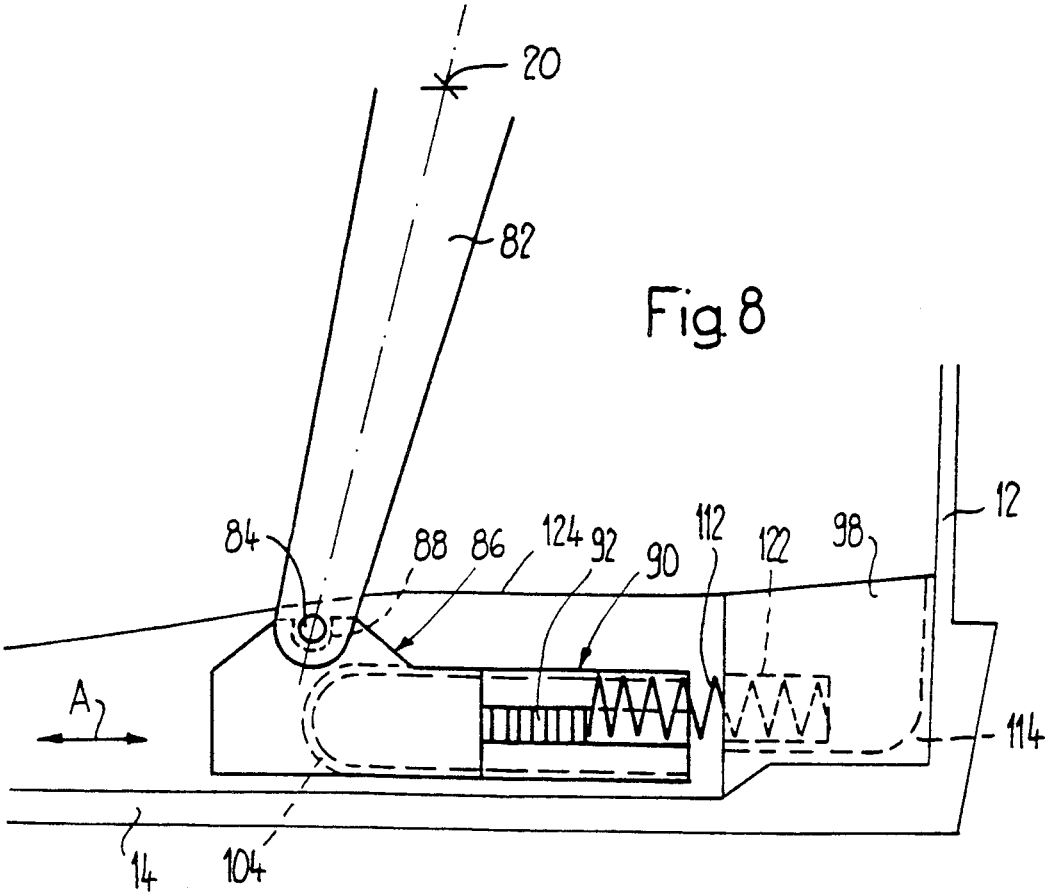
Figure 9:
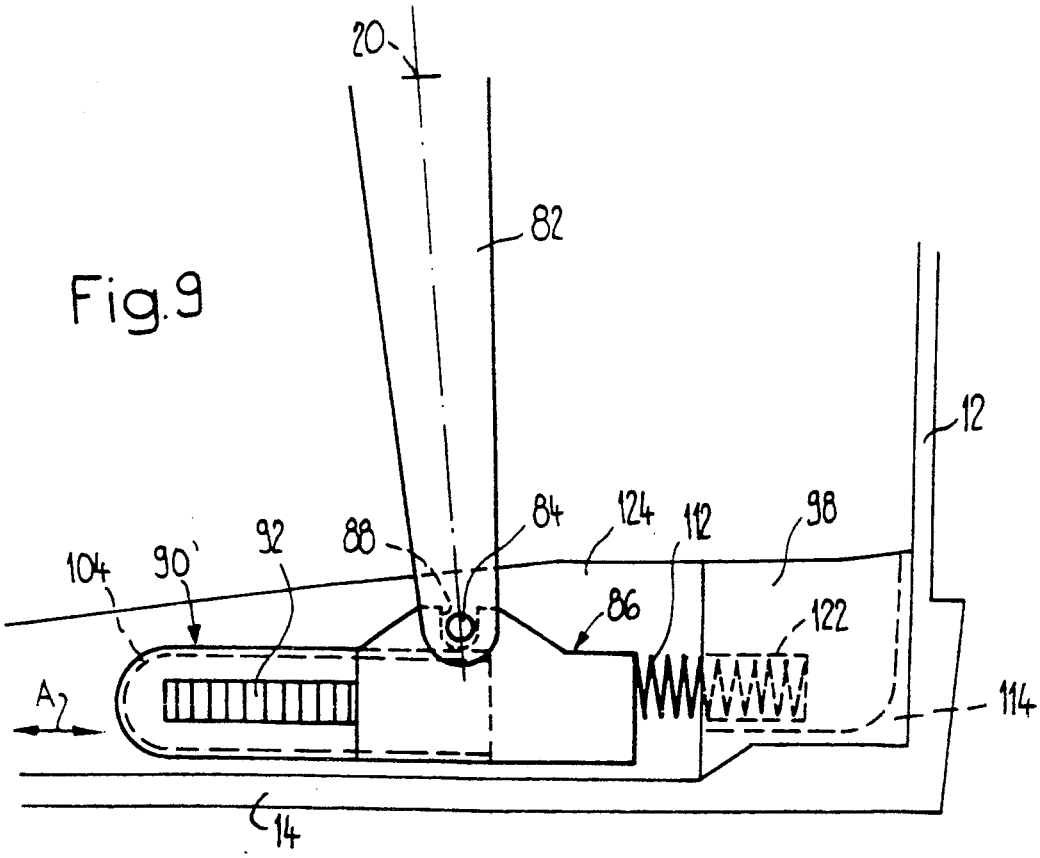

In FIGS. 6 to 9, the tensioning device 76 is represented in a simplified manner in a top view and elevation view respectively In FIGS. 6 and 8, seen in the longitudinal direction A of the boot, the tensioning member 90 is in its backward release position and in FIGS. 7 and 9, seen in the longitudinal direction A of the boot, it is shown in its forward tensioning position 90'. The shaft 84, which connects the two actuating levers 82 to one another, passes through the two transmission members 86 in the grooves 88. The pivoting movement of the actuating levers 82 about the axis 20 and the movement connected to it of the transmission members 86 is converted into an opposing movement of the tensioning member 90 by means of the toothed wheels 94 and the toothings 92 on the transmission members 86 and on the tensioning member 90. If the actuating levers 82 are in the pivoting position shown in FIGS. 6 and 8 with the longitudinal extension of the actuating lever 82 running forward at an angle, then the tensioning member 90 is displaced backwards into the release position. If, on the other hand, the actuating levers 82 are pivoted into the position shown in FIGS. 7 and 9, in which the longitudinal extension of the actuating levers 82 runs in a backward direction at an angle, the tensioning member 90 is in its forward tensioning position 90'. The guide grooves for the cable-shaped tensioning element 102 in the tensioning member 90 are indicated by 104. In the heel element 98, only the further guide channels 114 for the tensioning element 102 of the rear part loop 108 are indicated in broken lines (cf. FIG. 4). The damping springs 120 are held with their rear end area in blind holes 122 in the heel element 98. The front part area of each damping spring 120 projects forward in the longitudinal direction A of the boot beyond the heel element 98. Upon the displacement of the transmission members 86 out of their forward position shown in FIGS. 6 and 8 into the backward position represented in FIGS. 7 and 9, these each run up against a damping spring 120 after approximately half the displacement path. These damping springs 120 replace or complement the pressure spring elements 66 according to FIGS. 1 and 2.

In FIGS. 6 to 9, the lower shaft part 12 and the sole 14 are only schematically indicated. 124 indicates the foot bed which covers the tensioning device 76.

Upon displacing the tensioning member 90 into the tensioning position 90', the effective loop lengths of the two part loops 106 and 108 are shortened and the tensioning element 102 tensioned. Thereupon, the retaining element 96 is pulled by the front part loop 106 in a direction towards the sole 14 and by the rear part loop 108 in a direction towards the heel. At the same time, the heel cap 100 is pivoted in a forward direction. This provides the skier with secure retention in the ski boot. If, on the other hand, the tensioning member 90 is transferred into the release position shown in FIGS. 6 and 8, the effective loop lengths of the two part loops 106 and 108 are increased, as a result of which the tensioning element 102 is freed and the retaining element 96 as well as the heel cap 100 is released.

In order to put the ski boot on, the catch device 32 (cf. FIGS. 1 to 3) is disengaged and the upper shaft part 16 is pivoted out of the rest position, which is inclined forward in relation to the perpendicular 28 to the sole 14, counter to arrow direction B into the standing position 16'. This pivoting movement of the upper shaft part 16 is transmitted to the actuating levers 82 by means of the pivot pins 80. These levers are consequently pivoted into the position shown in FIGS. 6 and 8 which results in a displacement of the tensioning member 90 into the backward release position. The closure 26 is then opened and the rear shaft part 24 is pivoted backwards about the pivot pins 80. After the ski boot has been put on, the rear shaft part 24 is closed again and secured to the front shaft part 22 by means of the closure 26. In this connection, the tensioning member 90 remains in its release position and the foot can move relatively freely inside the ski boot. For the descent, the lower leg is then bent forwards, as a result of which the upper shaft part 16, that is to say the front shaft part 22 together with the rear shaft part 24, is pivoted forward in arrow direction B. As soon as the rest position 16 is reached, the catch tongue 40 engages on the nose 36. This pivoting movement of the upper shaft part 16 then results in the actuating levers being pivoted into the position shown in FIGS. 7 and 9. The tensioning member 90 is thus transferred forward in the longitudinal direction A of the boot into the tensioning position 90', which then results in the effective loop lengths of the two part loops 106, 108 being shortened and the tensioning element 102 being tensioned. By these means, the foot of the skier is securely retained in the ski boot. After the descent, the catch device 32 is released by means of pressure on the connecting part 52 of the double-armed lever 46. The upper shaft part 16 can thus be pivoted out of the rest position in to the standing position shown in FIG. 2 by 16'. This pivoting movement then results in the tensioning member 90 then being transferred into the release position shown in FIGS. 8 and 10. The retaining element 96 and the heel cap 100 are freed, as a result of which the foot can move relatively freely again inside the boot and relax. Moreover, problem-free walking is made possible with the ski boot. Upon the respective forward bending of the lower leg, the foot, according to the forward lean of the lower leg, is surrounded more firmly by the retaining element 96 and the heel cap 100 or the surrounding action is relaxed again. With the upper shaft part 16 in the standing position 16', and the tensioning element 102 thus automatically released, the ski boot can be put on or taken off easily when the rear shaft part 24 is folded back It is quite conceivable that a ski boot has a catch device according to FIGS. 1 to 3, in order to make possible a pivoting of the upper shaft part into the standing position, without the tensioning device for the foot retaining device being connected to this pivoting movement. It is of course also conceivable, to design a front-entry ski boot with a catch device. Advantageously, the latter is in this case arranged between the lower shaft part and the rear shaft part. For such a ski boot, the tensioning device for the foot retaining device can correspondingly be connected to the rear shaft part.

The catch device for the releasable holding of the upper shaft part in the rest position which is pivoted forward can also be designed other than shown in FIGS. 1 and 2. It is thus conceivable to arrange the catch nose on a catch lever mounted pivotably on the slide. By means of pivoting the catch lever, the catch nose is pulled out of engagement with the passage in the catch tongue. The catch lever is pretensioned in such a manner that it automatically engages again as soon as the upper shaft part 16 is pivoted into the rest position.

With the ski boot according to FIGS. 1 to 3, the rest position of the upper shaft part 16 can be adjusted in relation to the perpendicular 28 by means of rotation of the spindle 62. If such an adjustment is not desired, the catch nose can be formed rigidly on the lower shaft part and the lever mounted pivotably on the lower shaft part.

It is also possible that the tensioning device has its own releasable retaining device which is independent of the pivoting position of the upper shaft part. Thus, for example, a retaining lever can be provided, which is mounted pivotably on the heel element and which, when the tensioning member is in a tensioning position, prevents this tensioning member receding in a backward direction, even when the catch device for the upper shaft part is released. The tensioning member can then be freed by means of pivoting of the retaining lever from outside. In this case, the upper shaft part is only connected to the tensioning device via an entrainment device which is effective upon the forward pivoting of the upper shaft part. Such an embodiment is particularly suitable for skiing with a snow-board. The foot is securely retained in the lower shaft part by means of the foot retaining device, while the upper shaft part remains pivotable in relation to the lower shaft part.

It is of course also possible to mount the front and the rear shaft part on joints on the lower shaft part which are independent of one another. The foot retaining device can also be designed otherwise than is shown in FIG. 4.

While the invention has been described with reference to particular preferred embodiments, the invention is not limited to the specific examples given, and other embodiments and modifications can be made by those skilled in the art without departing from the spirit and scope of the invention.

What is claimed is:

1. A ski boot comprising:

a sole;

a shaft, a lower shaft part thereof enclosing the foot, a front shaft part surrounding the lower tibia area, and a rear shaft part provided in the area of the heel and the lower fibula and being pivotable about an axis which runs approximately parallel to the sole and transversely to a longitudinal direction of the boot;

a foot retaining device arranged inside the ski boot and being connected to a tensioning device, the tensioning device actuated by means of pivoting of the rear shaft part;

wherein the front shaft part and the rear shaft part are mutually releasably held in a closed position by a closure means, the closure means being independent from the tensioning device and the front shaft part is mounted on the lower shaft part about a pivoting axis which runs approximately parallel to the sole and transversely to the longitudinal direction of the boot, the front and rear shaft parts jointly pivotable out of a standing position when the ski boot is closed running approximately perpendicularly to the sole, into a forwardly inclined rest position, and wherein the tensioning device, driven by said joint pivoting movement of the front and rear shaft parts, tensions the foot retaining device; and a catch device, actuatable from outside the ski boot, for the joint releasable retention of the tensioning device and of the front and rear shaft parts when said parts are pivoted together into the rest position.

2. The ski boot as claimed in claim 1, wherein the foot retaining device comprises a tensioning element which is guided over an instep, and the tensioning device comprises a tensioning member which acts on the tensioning element for the tensioning of the tensioning element upon the pivoting of the front and rear shaft parts into the rest position.

3. The ski boot as claimed in claim 2, wherein the tensioning member is provided in the area of the sole.

4. The ski boot as claimed in claim 2, wherein the tensioning member is displaceable in the longitudinal direction of the boot by means of an actuating member connected to one of the front and rear shaft parts.

5. The ski boot as claimed in claim 1, wherein the ski boot is a rear entry ski boot.

6. A ski boot comprising:

a sole;

a shaft, a lower shaft part thereof enclosing the foot, a front shaft part surrounding the lower tibia area, and a rear shaft part provided in the area of the heel and the lower fibula and being pivotable about an axis which runs approximately parallel to the sole and transversely to a longitudinal direction of the boot; and a foot retaining device arranged inside the ski boot and being connected to a tensioning device, the tensioning device actuated by means of pivoting of the rear shaft part;

wherein the front shaft part is mounted on the lower shaft part about a pivoting axis which runs approximately parallel to the sole and transversely to the longitudinal direction of the boot, the front and rear shaft parts jointly pivotable out of a standing position when the ski boot is closed running approximately perpendicularly to the sole, into a forwardly inclined rest position, and wherein the tensioning device, driven by said joint pivoting movement of the front and rear shaft parts, tensions the foot retaining device; and wherein the foot retaining device comprises a tensioning element and the tensioning device comprises a tensioning member which acts on the tensioning element for the tensioning of the tensioning element upon the pivoting of the front and rear shaft parts into the rest position and which is displaceable in the longitudinal direction of the boot by means of an actuating member connected to one of the front and rear shaft parts, the actuating member being arranged inside the ski boot, pivotable about the pivoting axis of one of the front and rear shaft parts respectively and connected to a transmission member displaceable in the longitudinal direction of the boot in the sole area and connected to the tensioning member by means of a gear which reverses the direction of movement, and wherein the tensioning element is guided from behind, in the longitudinal direction of the boot, to the tensioning member.

7. The ski boot as claimed in claim 6, wherein the transmission member and the tensioning member have rack-shaped toothings running essentially in the longitudinal direction of the boot, and wherein a toothed wheel engaging said toothings is mounted on one of the sole and a sole insert, respectively, about an axis of rotation running essentially at right angles to the sole.

8. The ski boot as claimed in claim 7, wherein, on each side of the ski boot, an actuating member is provided, which is in each case connected to a transmission member, and wherein the two transmission members each act on the tensioning member by means of a toothed wheel.

9. The ski boot as claimed in claim 6, wherein the tensioning device is releasably lockable with the front and rear shaft parts pivoted into the rest position.

10. The ski boot as claimed in claim 6, further comprising a catch device, actuatable from outside the ski boot, for the joint releasable retention of the tensioning device and of the front and rear shaft parts when said parts are pivoted into the rest position.

11. A ski boot comprising:

a sole;

a shaft, a lower shaft part thereof enclosing the foot, a front shaft part surrounding the lower tibia area, and a rear shaft part provided in the area of the heel and the lower fibula and being pivotable about an axis which runs approximately parallel to the sole and transversely to a longitudinal direction of the boot; and a foot retaining device arranged inside the ski boot and being connected to a tensioning device, the tensioning device actuated by means of pivoting of the rear shaft part;

wherein the front shaft part is mounted on the lower shaft part about a pivoting axis which runs approximately parallel to the sole and transversely to the longitudinal direction of the boot, the front and rear shaft parts jointly pivotable out of a standing position when the ski boot is closed running approximately perpendicularly to the sole, into a forwardly inclined rest position, and wherein the tensioning device, driven by said joint pivoting movement of the front and rear shaft parts, tensions the foot retaining device; and wherein the foot retaining device comprises a tensioning element and the tensioning device comprises a tensioning member which acts on the tensioning element for the tensioning of the tensioning element upon the pivoting of the front and rear shaft parts into the rest position, the tensioning element forming at least one endless loop and being guided around the tensioning member to adjust the effective loop length upon the displacement of the tensioning member in the longitudinal direction of the boot.

12. The ski boot as claimed in claim 11, further comprising means for adjustment of the length of the endless loop.

13. The ski boot as claimed in claim 11, further comprising a heel retaining element and wherein the foot retaining device comprises a tensioning element connected to the heel retaining element, and the tensioning device comprises a tensioning member which acts on the tensioning element for tensioning the heel retaining element against the heel of a skier upon the pivoting of the front and rear shaft parts into the rest position.

14. The ski boot as claimed in claim 11, further comprising an upper retaining element and a heel retaining element and wherein the foot retaining device comprises a cable-like tensioning element guided over the upper retaining element in the instep region, around the heel retaining element and back to a top region of the upper retaining element, and wherein the tensioning device comprises a tensioning member which acts on the tensioning element for tensioning the tensioning element upon the pivoting of the front and rear shaft parts into the rest position.

15. The ski boot as claimed in claim 11, wherein the tensioning device is releasably lockable with the front and rear shaft parts pivoted into the rest position.

16. The ski boot as claimed in claim 11, further comprising a catch device, actuatable from outside the ski boot, for the joint releasable retention of the tensioning device and of the front and rear shaft parts when said parts are pivoted into the rest position.

17. The ski boot as claimed in claim 11, wherein the tensioning member is provided in the area of the sole.

18. A ski boot comprising:

a sole;

a shaft, a lower shaft part thereof enclosing the foot, a front shaft part surrounding the lower tibia area, and a rear shaft part provided in the area of the heel and the lower fibula and being pivotable about an axis which runs approximately parallel to the sole and transversely to a longitudinal direction of the boot; and a foot retaining device arranged inside the ski boot and being connected to a tensioning device, the tensioning device actuated by means of pivoting of the rear shaft part, wherein the tensioning device is in work connection with the front shaft part;

wherein the front shaft part is mounted on the lower shaft part about a pivoting axis which runs approximately parallel to the sole and transversely to the longitudinal direction of the boot, the front and rear shaft parts jointly pivotable out of a standing position when the ski boot is closed running approximately perpendicularly to the sole, into a forwardly inclined rest position, and wherein the tensioning device, driven by said joint pivoting movement of the front and rear shaft parts, tensions the foot retaining device.

* * * * *